United States Patent [19]

Krüger-Hoiss et al.

[11] Patent Number: 4,762,287

[45] Date of Patent: Aug. 9, 1988

[54] DEVICE FOR LAYING SPINNING CABLES INTO CONTAINERS

[75] Inventors: Werner Krüger-Hoiss, Neumünster; Hans-Joachim Heidel; Heinrich Trouë, both of Nortorf, all of Fed. Rep. of Germany

[73] Assignee: Neumünstersche Maschinen-Und Apparatebau GmbH, Neumünster, Fed. Rep. of Germany

[21] Appl. No.: 15,275

[22] Filed: Feb. 17, 1987

[30] Foreign Application Priority Data

Mar. 19, 1986 [DE] Fed. Rep. of Germany ..... 3609198

[51] Int. Cl.[4] ..... B65H 75/32

[52] U.S. Cl. ..... 242/48; 242/83; 83/175

[58] Field of Search ..... 242/83, 25 A, 48, 56 R; 83/18, 175, 466.1, 485, 379, 380; 140/2

[56] References Cited

U.S. PATENT DOCUMENTS

| | | | |
|---|---|---|---|
| 2,503,353 | 4/1950 | Pugh | 83/175 X |
| 2,544,784 | 3/1951 | Frum | 242/48 |
| 3,605,537 | 9/1971 | Pickler | 83/485 X |
| 4,489,900 | 12/1984 | Morizzo | 242/56 R |
| 4,627,318 | 12/1986 | Hochlehnert | 83/175 X |
| 4,669,676 | 6/1987 | Vehling | 242/83 X |

FOREIGN PATENT DOCUMENTS

| | | |
|---|---|---|
| 1934745 | 1/1971 | Fed. Rep. of Germany . |
| 2035020 | 1/1972 | Fed. Rep. of Germany . |

*Primary Examiner*—Stuart S. Levy
*Assistant Examiner*—Katherine Matecki
*Attorney, Agent, or Firm*—Michael J. Striker

[57] ABSTRACT

A cable-laying device for synthetic fibrous cable, which places a spinning cable into individual containers spaced from each other includes a roof-shaped supporting organ which overlaps the space between two adjacent container and includes two cable-supporting plates which are pivotable relative to each other between a closed inoperative position and an open operative position. Clamping yokes for clamping the cable are positioned on the supporting plates.

5 Claims, 6 Drawing Sheets

DEVICE FOR LAYING SPINNING CABLES INTO CONTAINERS

BACKGROUND OF THE INVENTION

The present invention relates to a device for laying spinning cables, particularly synthetic fiber cables laid into individual containers.

Devices of the type under consideration have been known. In one of such devices disclosed in DE-PS No. 20 35 020, a cable supporting organ is a rigid roof-shaped element which has along the ridge or edge of the "roof" a cut in the form of a slit. An incandescent wire, which is lowered into the slit from above has been provided as an organ for severing the cable. Flexible flaps with slide shoes have been secured to the support of the incandescent wire. These flaps serve as cable-supporting organs. The slide shoes which are adjusted to the slope of the "roof" are supported, during the lowering of the wire, at two sides of the slit on the "roof" surfaces, and clamp the cable lying on the supporting element during the separation process.

This known device, however is not sufficiently effective in practice. It is impossible during the transfer of the cable from one position to another to avoid that the cable which is loosely positioned on the supporting organ would occasionally plunge into the slit. The slide shoes can no longer pull the cable smoothly in such cases. Beads would form as a result. The reliable separation of the cable would no longer be ensured.

SUMMARY OF THE INVENTION

It is an object of the present invention to provide an improved device for laying spinning cables into individual containers.

It is another object of the invention to provide a device of the type under discussion, which is easy to operate.

These and other objects of the invention are attained by a device for laying spinning cables, particularly synthetic fibrous cables into containers, comprising at least two container-receiving means for each container; means for an automatic container exchange, a roof-shaped supporting organ for supporting a cable being layed into the container, said supporting organ including two oblique supporting plates and bridging an intermediate space between two receiving means; a cable-separating organ insertable into a slit formed between said supporting plates at a ridge edge of said supporting organ; and clamping means for rigidly holding a cable on said supporting organ, said supporting plates being movable relative to each other between an inoperative position in which said supporting plates tightly abut against each other along said ridge edge, and an operative position in which said supporting plates are separated from each other by said slit, said clamping means being connected to said supporting plates.

The reliable operation of the device is obtained by the following process: during the position change, the cable firstly is loosely laid over the closed supporting organ. Then the cable is rigidly clamped at two sides of the supporting organ. Then, upon the expansion of the supporting organ, a slit between the supporting plates opens whereby the cable is stiffly pulled. In this position the cable is cut off. Thus there is no chance that the cable would miss the separating organ.

The clamping means may include folding yokes each arranged on a respective supporting plate.

The cable-separating organ may include a rotary cutting disk; the device further including a horizontal rail, and a carriage displaceable on said rail, said cutting disk being mounted on said carriage. The lateral arrangement of the cable-separating organ enables an unobstructed transfer of the cable whereas the utilization of the rotating cutting disk ensures a smooth cut without melting the ends of the cable being cut as is the case with conventional incandescent wires.

The device may further include an upright, on which said supporting organ with said cable-separating organ is mounted, said upright being laterally pivotable about a hinge provided near a base of said upright. Thereby the end of the cable which is transferred to the empty container is prevented from being pulled into the container.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawing.

DETAILED DESCRIPTION OF THE PREFERRED EMBODIMENTS

Figure 1:
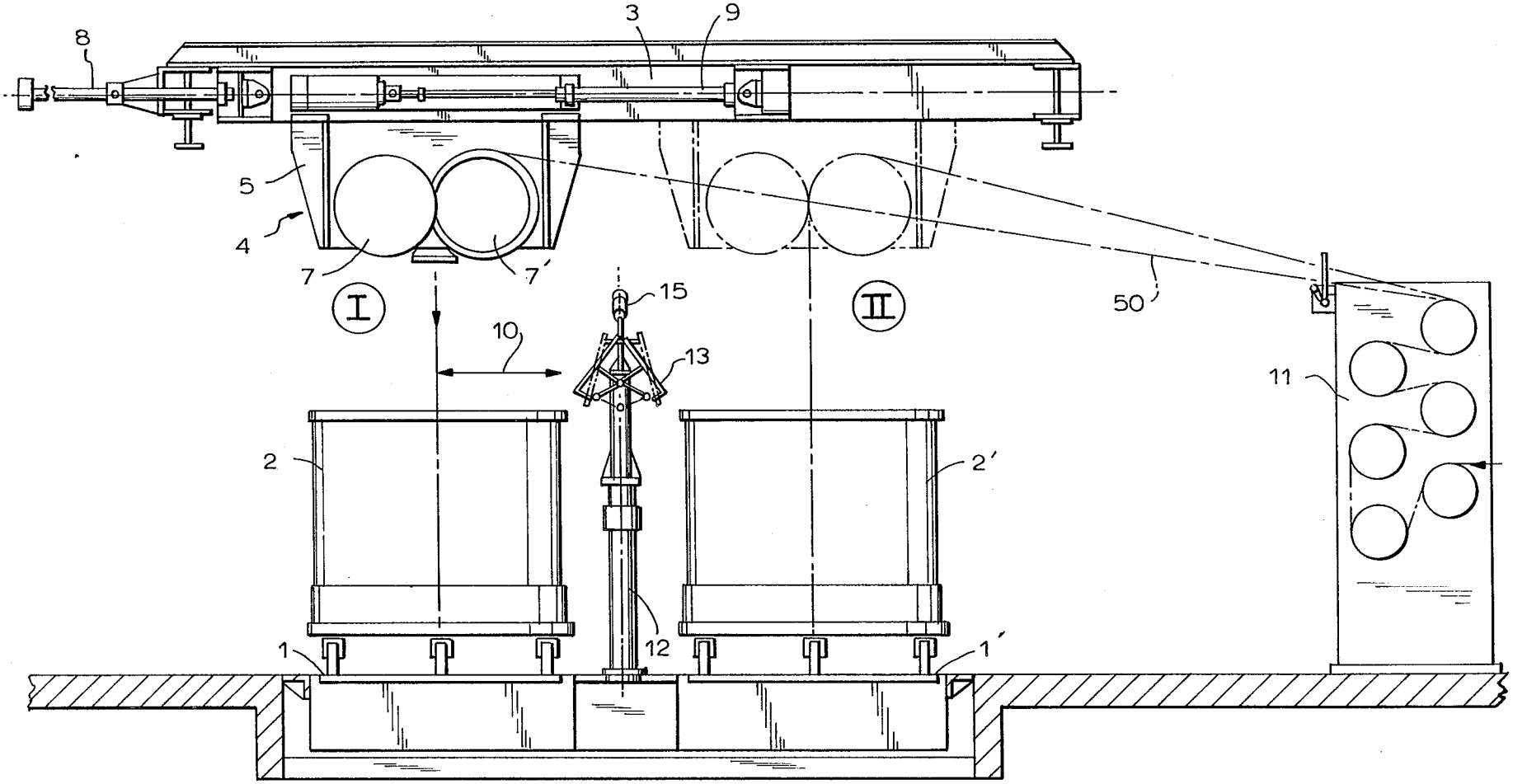
FIG. 1 is a front view of the device for laying down spinning cables into cans, according to the invention.
Figure 2:
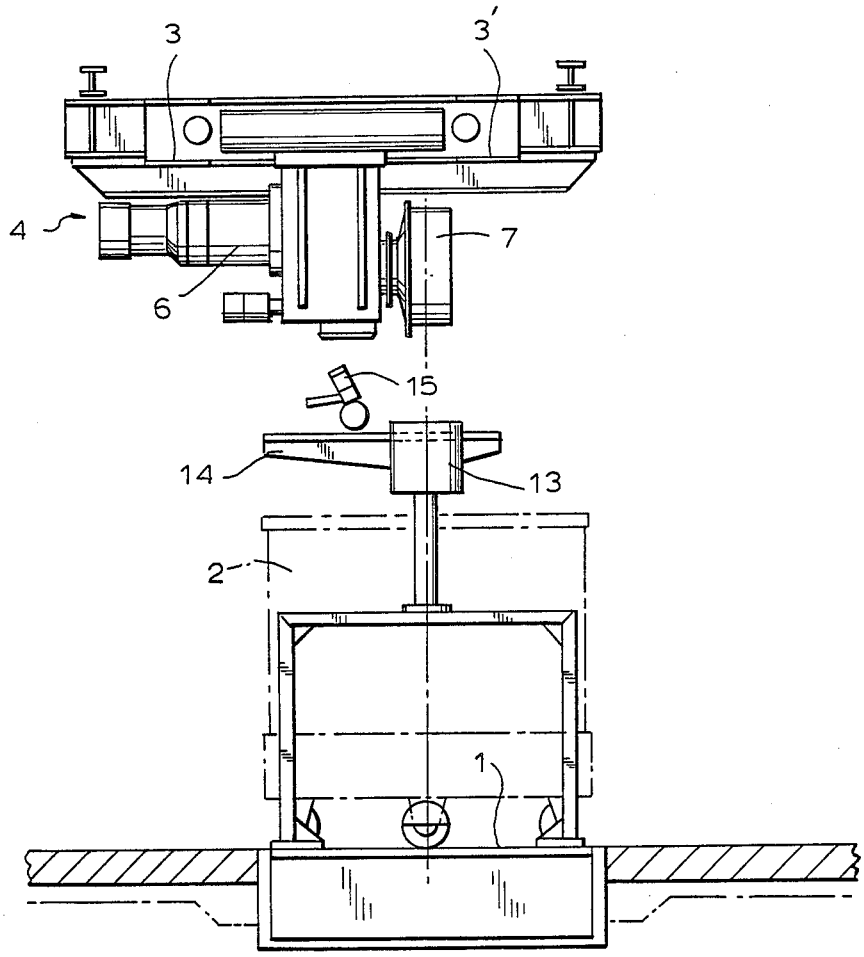
FIG. 2 is a side view of the device of FIG. 1.

Referring now to the drawings in detail, FIGS. 1 and 2 show the device which has two container or can positions I and II. A rotary disk 1, 1' inserted in the base of the device is provided for each position. A can or container 2, 2' is placed on each rotating disk 1, 1'.

A feeding device 4 is suspended on a stationary rail 3, 3' above the can positions I and II. The feeding device 4 is comprised substantially of a carriage 5 in which two reels 7, 7' provided with a drive 6 are positioned.

The feeding device 4 shown in FIG. 1 with solid line is in the position corresponding to the can position I. The feeding device is displaceable from the position shown in solid line to the position shown in dash-dotted line, which corresponds to the can position II, by means of a piston 8. The feeding device is in each position thereof adjustable by means of a piston 9 so that the feeding device can move back and forth over a distance between two reels 7 and 7', which distance is designated by arrow 10, between the axis of container 2 and the rim of the container. This motion will be identified as a traverse motion.

A supply mechanism 11 is positioned near the cable laying device.

A supporting organ 13 which covers or overlaps a space between two can positions I and II is positioned on an upright or column 12. A T-shaped traverse 14 is also positioned on the upright or column 12. A separating organ 15 is displaceable on this traverse 14 in the horizontal direction.

The separating organ is a customarily available so-called round cutter machine. Such machines are available on the market as hand-held devices and utilized for cutting materials for packaging clothes. The round cutting machines have a frame with a handgrip 16 (FIG. 3) and a foot plate 18 which, at the front edge thereof, which faces away from the handgrip 16, is inclined or wedge-shaped.

Figure 4:
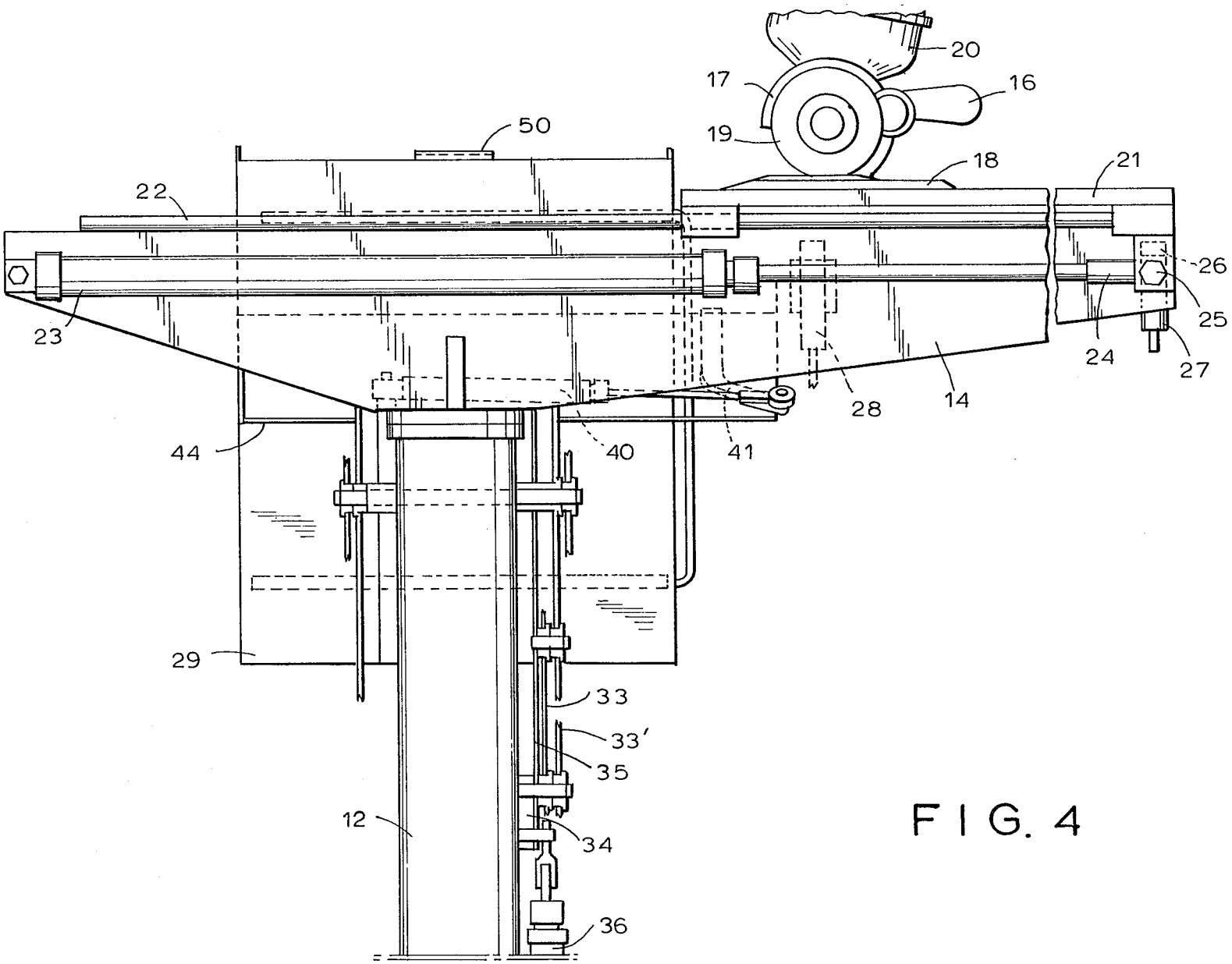
FIG. 4 is a side view of the detail shown in FIG. 3.

A circular or polygonal cutting disk 19 is connected to the frame of the cutting machine. The cutting disk 19 is, by means of an electric or pneumatic device 20, rotatable about the horizontal axis (FIG. 4). The cutting disk 19 extends with its narrow segment in a slot provided on the foot plate 18. The foot plate 18 is rigidly screwed to a carriage 21 which is slideable along a rail 22 which in turn is screwed to the upper side of the traverse 14. In the normal position illustrated in FIG. 4, carriage 21 is located at the end of traverse 14 whereby the wedge-shaped rim or edge of the foot plate 18 is pointed towards the column 12. From this position, carriage 21 is displaceable in the direction towards the column 12 by means of a cylinder-piston unit 23, which with its piston rod lug 24 is engaged with a pin 25 secured to the carriage 21. A hook-shaped projection 26 is situated at the underside of the carriage 21. Two contactless switches 27, 28 are positioned laterally of the traverse 14 in the immediate vicinity of the movement path of projection 26. Switch 27 is situated on the end of the traverse 14, on which carriage 21 is located in its base position. The other switch 28 is spaced from the switch 27.

Figure 3:
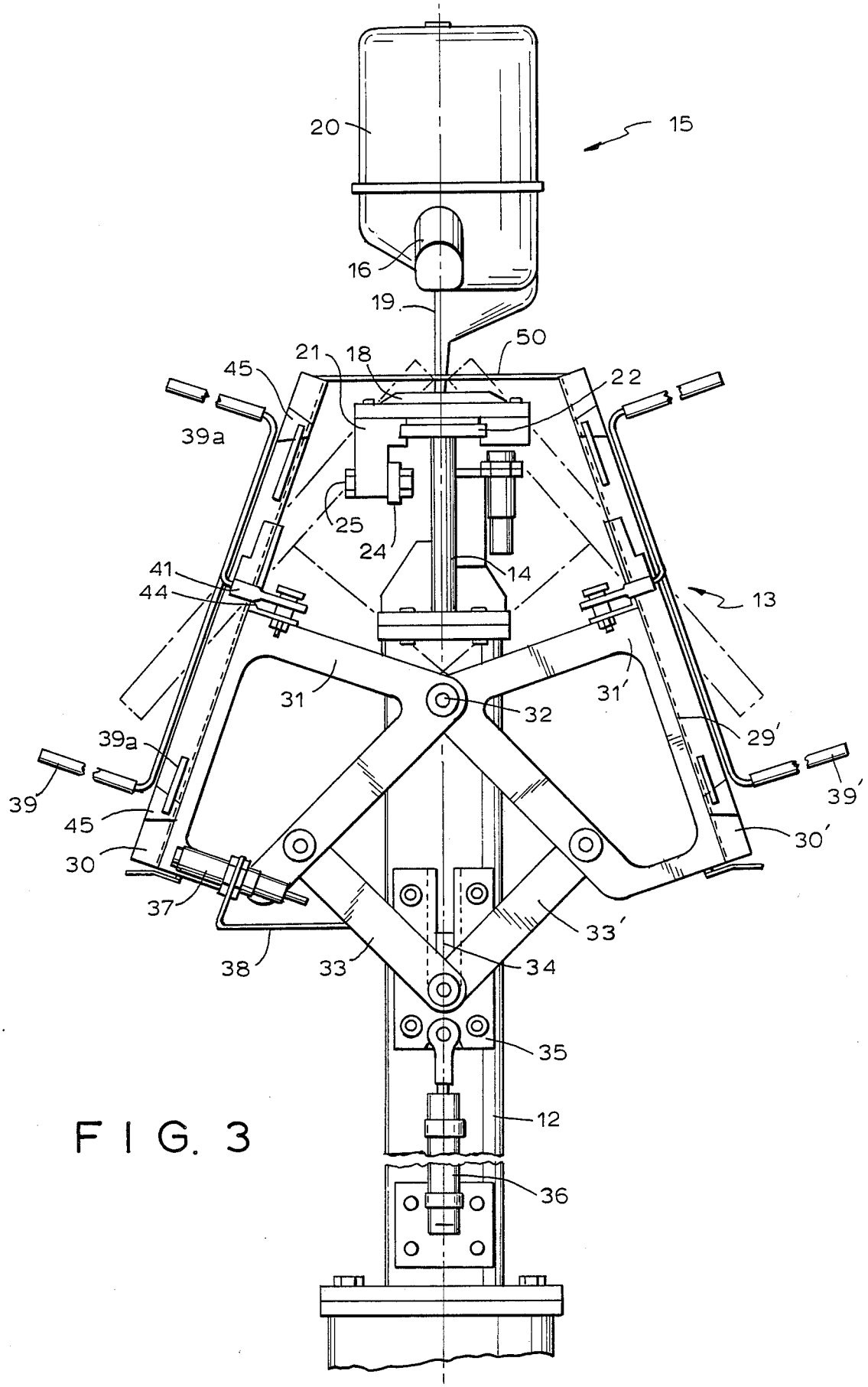
FIG. 3 is a detail of the device of FIG. 1, as seen from the front thereof.

The supporting organ 13 has two flat rectangular supporting plates 29, 29' with highly curved edges 30, 30'. Supporting plates 29, 29' which are shown in FIG. 3 with dotted lines in the normal or inoperative position are mirror-inverted and inclined in respect to the plane formed by the column 12 and traverse 14 so that at their upper edges they tightly abut against each other and together form a roof which covers a part of rail 22.

The angle of inclination of supporting plâtes is between 40° and 50° . Trapezoid-shaped holders or supports 31, 31' are positioned on the undersides of supporting plates 29, 29'. These supports and the supporting plates 29, 29' therewith are pivotable about a common pivot pin 32 which extends parallel to the "ridge" of the roof formed by supporting plates 29, 29' and connected, approximately at the level of the lower edge of the roof, to the column 12.

Symmetrically inclined to each other and pivotally supported on supports 31, 31' below the pivot pin 32 are the ends of two arms 33, 33'.

The opposite ends are pivoted via a common intermediate piece 34 which is positioned in a slide guide 35, on a piston-cylinder unit 36 which in the vertical position is connected to column 12. By the actuation of the piston-cylinder 36, the supporting plates 29, 29' are selectively pivoted to the normal position shown in dotted lines or to an operative position shown in solid lines. In the operative position, in which the supporting plates 29, 29' are separated from each other along the "ridge" of the roof by a slit the supporting plate 29 is positioned in the immediate proximity from the end switch 37 which is connected by a holder 38 to the column 12.

A fork-shaped clamping yoke 39 is positioned on the upper side of the supporting plate 29. This yoke is selectively placed to the inoperative position or the engaging or clamping position. Both dovetail parts of the fork of this yoke in the inoperative or normal position extend somewhat perpendicular to the supporting plate 29 as can be best seen in FIG. 5. In the cable-engaging position these dovetail parts of the fork-shaped yoke lie flat on the supporting plate. The folding of the yoke 39 is performed with the aid of the piston-cylinder unit 40 which lies horizontally about half the height on the underside of the supporting plate 29 and is engaged with a lever 41.

Figure 5:
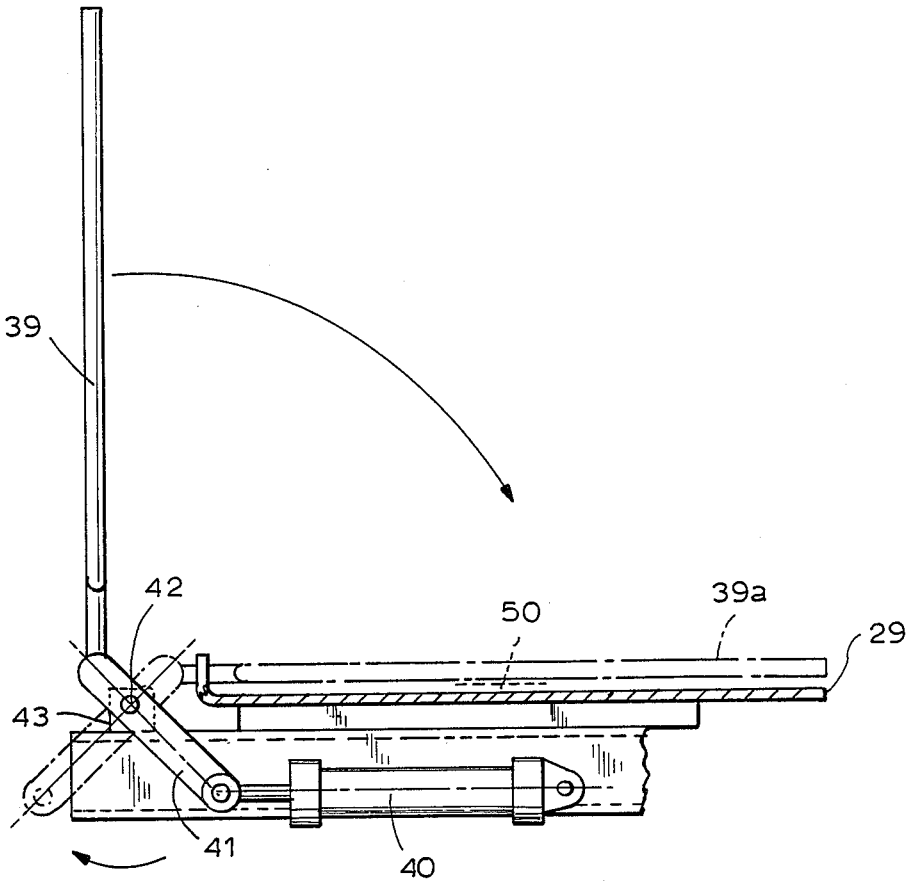
FIG. 5 is a partial view of the unit.

Lever 41 which is rigidly connected with the clamping yoke 39 and is formed as a forked strut, also called a Y-strut, is pivotable about a pin 42 which is supported in a block 43. The latter is situated at the laterally protruding end of an angular piece 44 shown in FIG. 4. Angular piece 44 is connected half the height transversely to the underside of the supporting plate 29. Pin 42 is positioned a short distance above the upper side of the supporting plate but laterally spaced from the supporting plate and parallel to its side edge. In order to enable the folding of the clamping yoke 39 the highly curved edges of the supporting plate 29 are provided with recesses 45. In FIGS. 3 and 5 the folded clamping yokes are designated by numerals 39*a*.

The supporting plate 29' is provided with the clamping yoke 39' in the manner similar to that for the supporting plate 29.

Figure 6:
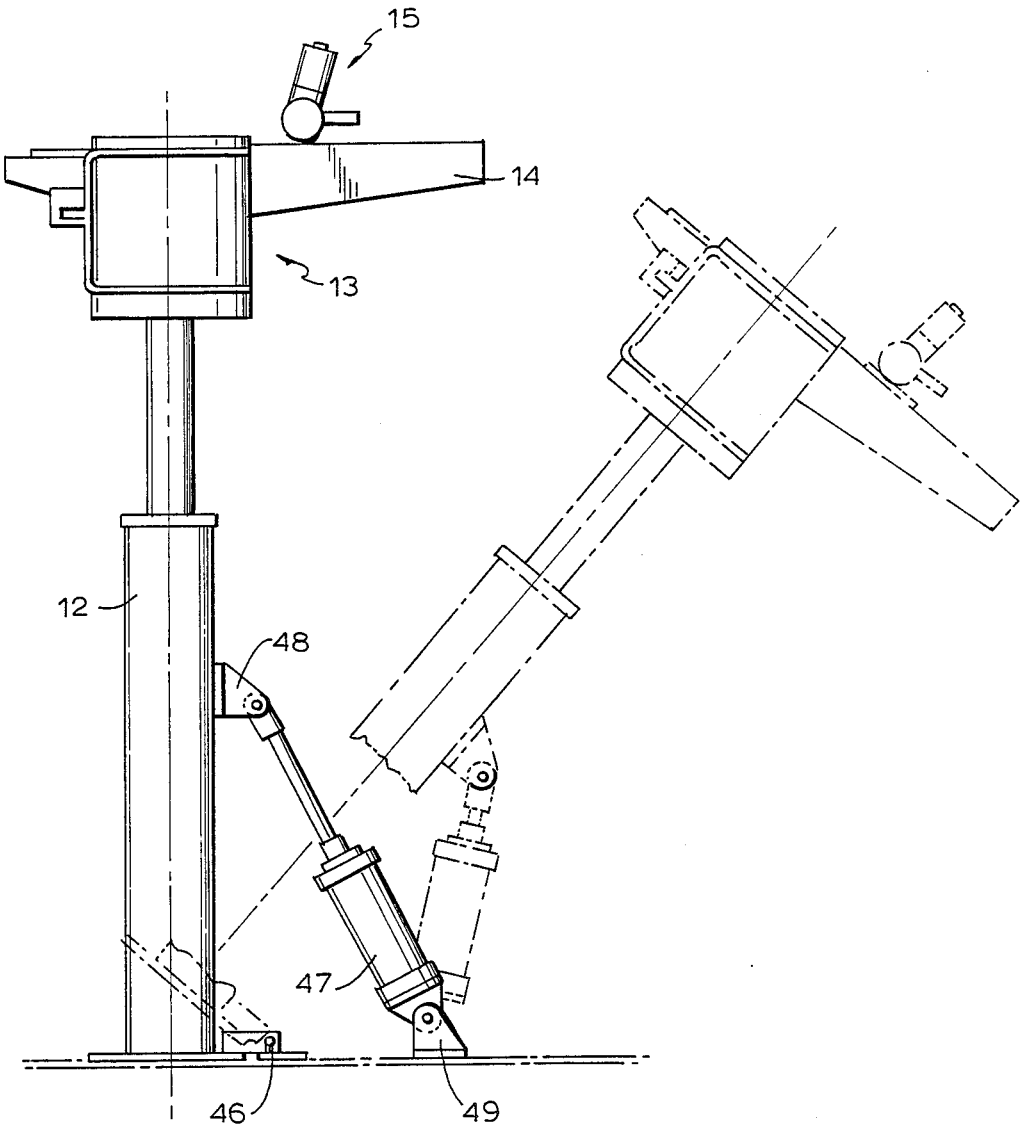
FIG. 6 shows a part of the device, in a side view, in two different positions.

With reference to FIG. 6 it will be seen that column 12 is pivotable, about a hinge 46 positioned on the foot of the column, in the plane formed by column 12 and traverse 14, this plane being transversal to the axes of both containers 2,2'. The pivoting motion from the vertical normal position to the inclined position at the angle about 45° is carried out by means of a piston-cylinder unit 47 which, at the one end, at about half the height of column 12, is connected to a hinge lug 48 secured to column 12 and, at the other end is connected to a hinge lug 49 connected to a base plate and spaced from the column 12.

The mode of operation of the device for laying down a cable into containers is as follows:

In the position depicted in FIG. 1, cable 50 is fed by the supply mechanism 11 and the feeding device 4 to the container rotating about its axis. When the can or container 2 is filled firstly the drive of the rotating disk 1 is switched off. The traverse motion of the feeding device 4 is eventually stopped so that a play between two reels 7 and 7' is formed above to the center the can 2. Cylinder 8 now moves the feeding device 4 from position I to position II. Thereby cable 50 is layed via the "roof" formed by the supporting plates 29, 29', which "roof" is yet in the closed normal position.

Carriage 21, on which the separating organ 15 is mounted, is now moved by the piston-cylinder unit 23 from the normal position in the direction towards column 12. When the projection 26 passes the switch 28 the drive of the separating organ 15 is automatically switched on. Approximately at the same time, the clamping yokes 39, 39' released by switch 28 drop on the supporting plates 29, 29' and rigidly hold the cable 50 at both sides.

With some delay in time, the cylinder-piston unit 36 pivots the supporting plates 29, 29' to the operative position. Thereby cable 50 is stiffly pulled via the slit between the upper edges of the supporting plates, which is now open. Switch 37 issues a signal that the supporting organ 13 is in the operative position. The separating organ 15 is now moved into the clearance or slit between the supporting plates 29 and 29' and severs cable 50. The separation of cable 50 is complete because the fibers can not avoid the cutting disk 19. After the separation of the cable, the separating organ 15 travels back to its normal or inoperative position. Upon reaching this position, switch 27 issues a respective signal. The drive of the separating organ is shut off, the "roof" of the two supporting plates 29, 29' closes, and the clamping yokes 39, 39' are hinged back to their normal position. One end of the cable hangs over the rim of the filled container 2 whereas the other end of the cable falls into the empty container 2'. The traverse motion of the feeding device 4 is again started, and the drive of the rotating disk 1' is switched on.

Due to the specific embodiment illustrated in FIG. 6 the mode of operation can be changed if desired as follows:

After the separation of cable 50 but before backward hinging of the clamping yokes 39, 39', column 12 is laterally tilted. Then the ends of the severed cable are released by the backward folding of the clamping yokes 39, 39'. The cable ends are substantially longer. One end of the severed cable is not pulled into the empty container 2' but hangs over the rim of this container as well the other end of the cable hangs over the rim of the full container 2. Both ends of the cable can be provided with knots by an operator so as to avoid the fanning out of the cable. The end of the cable which hangs over the empty container is secured to the rim of this container, for example by a glue strip. Then firstly the drive of the rotating disk 1' is switched on. The hanging ends of the cable have during the further treatment the advantage that the cable end on one container can be easily connected to the starting end of the cable hanging on the other container, and the cable can be continually processed in the device according to the invention.

It will be understood that each of the elements described above, or two or more together, may also find a useful application in other types of devices for laying cables into individual containers differing from the types described above.

While the invention has been illustrated and described as embodied in a device for laying a spinning cable into individual containers, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A device for laying spinning cables, particularly synthetic fibrous cables into containers, comprising at least two container-position means for each container; means for an automatic container exchange; a roof-shaped supporting organ for supporting a cable being laid into the container said supporting organ including two oblique supporting plates and bridging an intermediate space between two of the container-position means; a cable separating organ and means for moving the cable-separating organ to a position above said supporting organ; clamping means for rigidly holding a cable on said supporting organ; and means for moving said supporting plates relative to each other between an inoperative position, in which said supporting plates tightly abut against each other along a ridge edge of said supporting organ, and an operative position in which said supporting plates are separated from each other so as to form therebetween at said edge a slit so that said cable-separating organ which has been moved to the position above said supporting organ is inserted into said slit to severe the cable held by said supporting plates only when said supporting plates are in said operative position, said clamping means being connected to said supporting plates.

2. The device as defined in claim 1, wherein said clamping means include folding yokes each arranged on a respective supporting plate.

3. The device as defined in claim 2, wherein said cable-separating organ includes a rotary cutting disk; and further including a horizontal rail, and a carriage displaceable on said rail, said cutting disk being mounted on said carriage.

4. The device as defined in claim 3; further including an upright on which said supporting organ and said cable-separating organ are mounted, said upright being laterally pivotable about a hinge provided near a base of said upright.

5. The device as defined in claim 1, wherein said supporting plates are provided with means to pivot said supporting plates between said inoperative and operative positions.

* * * * *